US008122789B2

(12) United States Patent
Vinciguerra et al.

(10) Patent No.: US 8,122,789 B2
(45) Date of Patent: Feb. 28, 2012

(54) DEVICE FOR TIGHTENING OF A GLAND NUT

(75) Inventors: Giorgio Vinciguerra, Buccinasco MI (IT); Luciano Manara, Milan (IT); Andrea Sirtori, Lissone MI (IT)

(73) Assignee: Peroni Pompe S.p.A., Milan (IT)

( * ) Notice: Subject to any disclaimer, the term of this patent is extended or adjusted under 35 U.S.C. 154(b) by 1306 days.

(21) Appl. No.: 11/666,295

(22) PCT Filed: Oct. 28, 2005

(86) PCT No.: PCT/EP2005/011571

§ 371 (c)(1), (2), (4) Date: Apr. 26, 2007

(87) PCT Pub. No.: WO2006/066651

PCT Pub. Date: Jun. 29, 2006

(65) Prior Publication Data

US 2008/0115630 A1 May 22, 2008

(30) Foreign Application Priority Data

Dec. 20, 2004 (EP) ..... 04425928

(51) Int. Cl.
*B25B 13/48* (2006.01)

(52) U.S. Cl. ..... 81/57.39

(58) Field of Classification Search ..... 81/176.1, 81/176.15, 176.2, 57.39
See application file for complete search history.

(56) References Cited

U.S. PATENT DOCUMENTS

| | | | | | |
|---|---|---|---|---|---|
| 1,384,684 | A | * | 7/1921 | Watkins | 81/176.1 |
| 1,613,121 | A | * | 1/1927 | Oppman | 137/512 |
| 1,752,074 | A | * | 3/1930 | Gagne | 81/176.1 |
| 2,420,458 | A | * | 5/1947 | Barker | 81/176.1 |
| 3,181,474 | A | * | 5/1965 | Yohpe | 417/568 |
| 3,815,211 | A | | 6/1974 | Acord, IV | |
| 4,117,735 | A | * | 10/1978 | Wagner et al. | 74/47 |
| 4,186,629 | A | | 2/1980 | Costes | |
| 4,309,923 | A | * | 1/1982 | Wilmeth | 81/57.34 |
| 4,351,512 | A | | 9/1982 | Siver | |
| 5,301,574 | A | * | 4/1994 | Knopp et al. | 81/57.39 |

FOREIGN PATENT DOCUMENTS

| | | | |
|---|---|---|---|
| DE | 102 22 159 | A1 | 11/2003 |
| FR | 2 670 423 | A | 6/1992 |
| GB | 739 996 | A | 11/1955 |
| GB | 784 708 | A | 10/1957 |
| GB | 1 502 650 | | 3/1978 |

OTHER PUBLICATIONS

International Search Report for PCT/EP2005/011571 mailed Jan. 16, 2006.

* cited by examiner

*Primary Examiner* — Devon C Kramer
*Assistant Examiner* — Nathan Zollinger
(74) *Attorney, Agent, or Firm* — Nixon & Vanderhye PC

(57) ABSTRACT

A device (1) for the adjustment of a gland nut (2), provided with a plurality of gripping means (8) through which said gland nut (2) can be caused to rotate, comprising an engaging member (3) and actuator means (25, 26) to cause the engaging member (3) to effect a working movement from a first position to a second position. The engaging member (3) is capable of effecting one-way engagement with the gripping means (8) to rotate the gland nut (2) through a predetermined angle (α) in the working movement from the first position to the second position.

8 Claims, 3 Drawing Sheets

DEVICE FOR TIGHTENING OF A GLAND NUT

Figure 1:
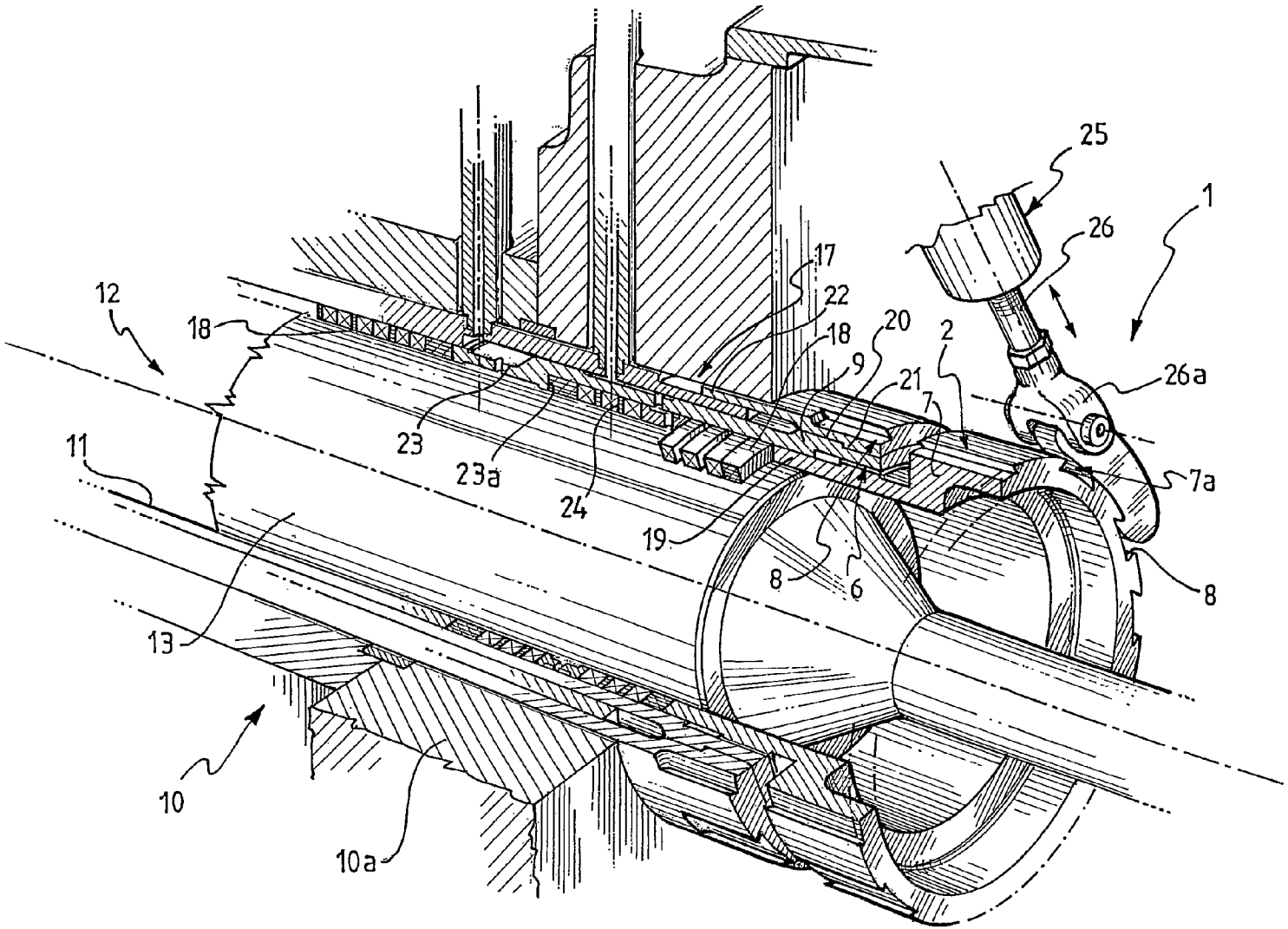

This application is the U.S. national phase of International Application No. PCT/EP2005/011571 filed 28 Oct. 2005 which designated the U.S. and claims priority to EP 04425928.1 filed 20 Dec. 2004, the entire contents of each of which are hereby incorporated by reference.

This invention relates to a device for the adjustment of a gland nut according to the preamble of Claim 1.

In particular, this invention finds application in the adjustment of a gland nut in pumping equipment, such as alternating pumps.

The use of annular seals in pumping equipment provided with alternating systems or rotating shafts for the movement of a fluid is known. These seals, typically made of resilient or compressible materials, prevent the occurrence of leaks around the rotating shaft or alternating system of a pump and as a consequence leakage of the pumped fluid outside the pump.

Typically these seals, in the shape of rings, are housed in a gland box which also comprise a gland arranged as a collar on the shaft or piston which is capable of axially compressing the sealing rings against a fixed wall of the gland box.

The seal is obtained by making use of the axial compression force exerted by the gland on the sealing rings which deform in a radial direction as the result of this compression force, pressing against and adhering to the cylindrical wall of the shaft or piston and therefore preventing escape of the pumped fluid present in the pump. It should be noted that a leak of the pumped fluid is however always present, although in negligible quantities.

However it should be pointed out that while the pump is in operation the sealing rings are worn away by friction against the walls of the alternating piston or rotating shaft. This causes appreciable losses around the gland which are not sustainable, with a consequent fall in the volumetric capacity of the pumping system. It should also be pointed out that the fluids used in these pumping systems often contain potentially hazardous components which could damage the surrounding environment and/or the pump itself if they escape from the pump.

In order to maintain an adequate level of compression by the gland on the sealing rings it is necessary to adjust the gland.

With this object the gland has a threaded portion engaged by a threaded portion of the gland box or other member which is fixed with respect to the gland and gripping means through which it is possible to cause a gland nut to rotate.

Typically the gland nut is adjusted at periodical intervals, or whenever an operator notices a leak of liquid from the gland nut.

Adjustment is performed by an operator who engages the gripping means of the gland nut using a suitable tool and rotates the nut so as to re-establish adequate compression on the sealing rings and thus prevent losses of liquid from the gland nut.

This adjustment of the gland nut has a number of disadvantages however. First of all, adjustment of the nut and therefore tightening of the sealing rings is dependent on the operator carrying out the operation. Also the operator's position during this operation is hazardous in that given the size of some pumping equipment the operator must mount the body of the pump, in particular between moving components of the pump, and therefore work under conditions of precarious equilibrium, having to apply considerable tightening forces with little safety. Furthermore the need to periodically adjust the gland nut gives rise to an increase in maintenance costs and the need to repeatedly check the presence of leaks from the gland nut.

Various solutions have been proposed to overcome these disadvantages.

One proposed solution provides for the use of preloaded springs which always maintain the gland in compression against the sealing rings. Although overcoming some of the abovementioned problems, this solution has disadvantages from the construction and functional points of view, particularly as regards wear on the sealing rings. In fact the use of preloaded springs makes it necessary to provide an initial load on the spring which is greater than the load which is strictly necessary to maintain an adequate gland seal, that is the springs have to be overdimensioned. This is due to the fact that springs have to be able to maintain an adequate load even when the sealing rings are partly worn. However this requirement itself gives rise to rapid wear of the sealing rings because the sealing rings are initially compressed more than is necessary.

A different arrangement provides for the use of a pressurised hydraulic fluid producing a continuous axial thrust on the gland. This arrangement too has disadvantages. First of all it is necessary to provide hydraulic connections to the gland, with an increase in the overall cost of the pumping equipment and greater complexity in its structure. Also, while the alternating pump is in operation, movement of the alternating piston gives rise to fluctuations in the fluid pressing on the gland, with consequent oscillation of the pressure force exerted by that fluid on the gland.

Thus although overcoming the disadvantages found with glands adjusted manually, glands of the known type mentioned above have appreciable disadvantages because of the rapid wear of the sealing elements and the poor efficiency of the members responsible for adjustment of the same.

As a consequence there is an appreciable need for a device for the adjustment of a gland nut through which it is possible to desirably adjust the degree of tightening of the sealing members avoiding rapid wear. In particular it is desired to be able to control and calibrate the degree of tightening in adjustment of the gland nut according to losses.

The object of this invention is to provide a device for the adjustment of a gland nut having structural and functional characteristics sufficient to satisfy the abovementioned requirements and at the same time overcome the disadvantages mentioned with reference to the known art.

This object is achieved through the adjustment of a gland nut according to Claim 1.

Figure 2:
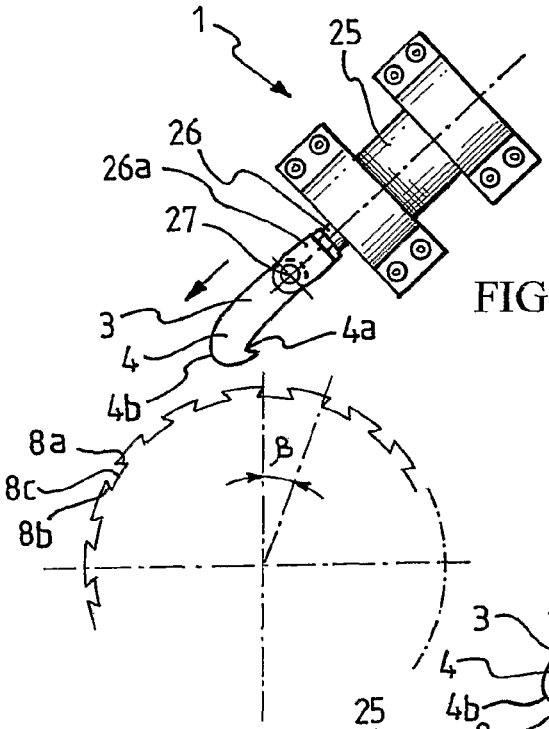
Figure 3:
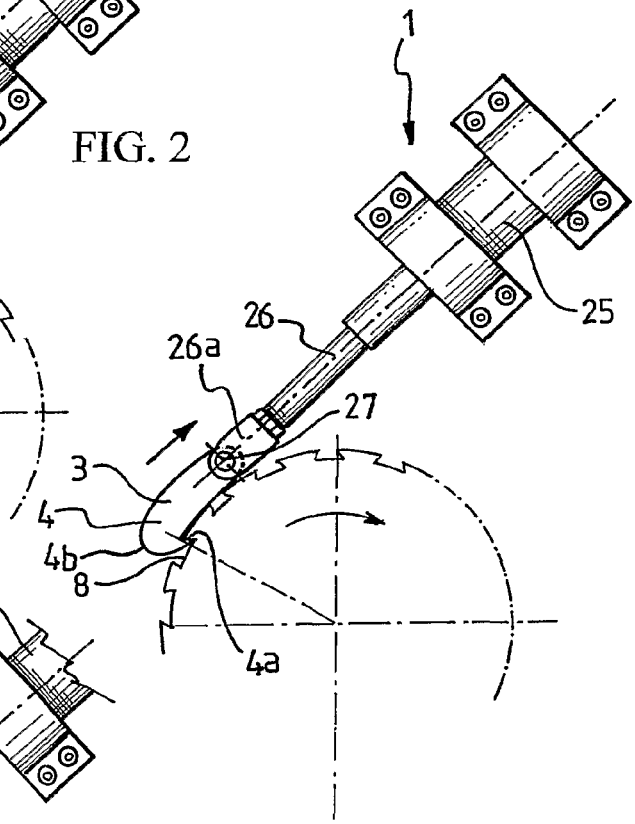
Figure 4:
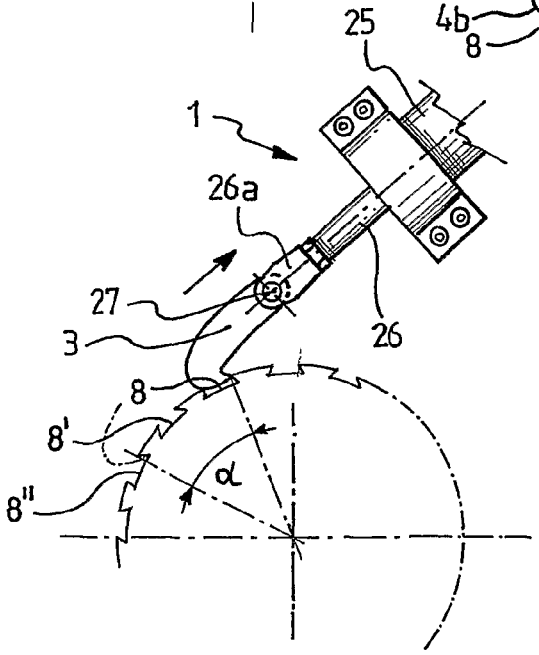
Figure 5:
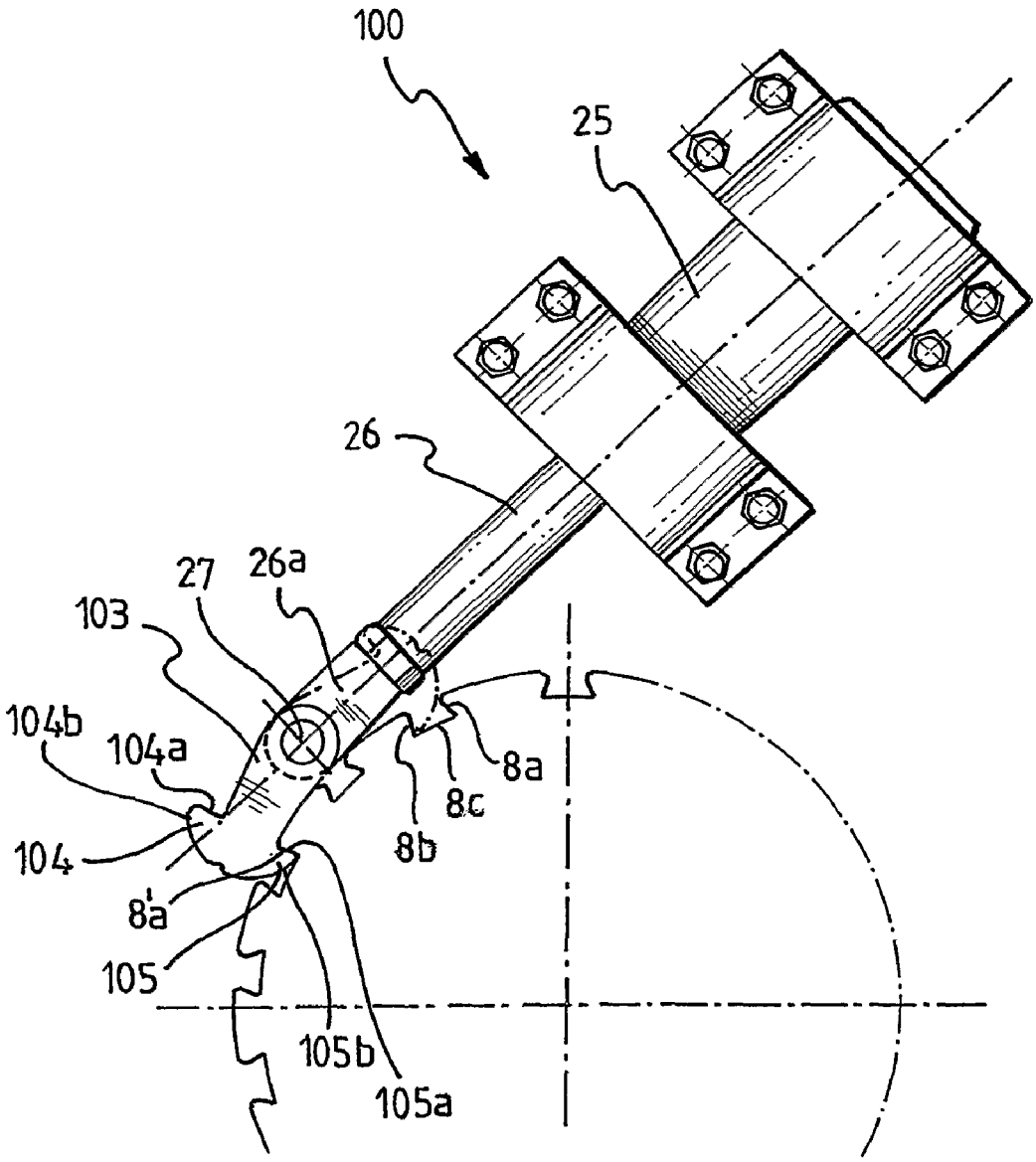

Further features and advantages of the device for adjusting the gland nut according to this invention will be apparent from the description of a preferred embodiment provided below purely in an indicative and non-limiting way with reference to the appended figures, in which:

FIG. 1 shows a diagrammatical perspective view of a device for the adjustment of a gland nut according to the invention in partial cross-section, FIGS. 2 to 4 show diagrammatical plan views of the device in FIG. 1 in successive operating positions, and FIG. 5 shows a diagrammatical plan view of a second embodiment of a device for the adjustment of a gland nut according to the invention.

With reference to FIGS. 1 to 4, 1 indicates as a whole a device for the adjustment of a gland nut 2.

This description makes particular reference to a device 1 for the adjustment of a gland nut 2 of an alternating pump 10. However, the device for the adjustment of a gland nut according to the invention may find application in different pumping equipment or other equipment where it is necessary to restrict fluid losses and therefore adjust a gland nut.

In a manner which it in itself known alternating pump 10 comprises a housing 11 forming a longitudinal cavity 12 within which there is mounted a piston 13.

The alternating pump also comprises a conduit (not shown in the figures) for conveyance of the fluid pumped by the pump, which conduit is in fluid communication with housing 11 and has an inlet opening at one end and an outlet opening at the opposite end.

Piston 13 is able to move along longitudinal cavity 12 in alternating motion to draw off a fluid through the suction inlet and discharge the fluid through the discharge outlet.

In order to prevent leaks of fluid outside housing 11 of pump 10, pump 10 has an annular gland chamber 17 located coaxially with piston 13 of pump 10 and of one piece with the supporting structure 10*a* of pump 10. A plurality of annular sealing members 18 are housed within gland chamber 17. Sealing members 18, for example of the packed type, comprise resilient or compressible material.

In a manner which is in itself known, alternating pump 10 comprises a gland 19 capable of applying an axial compression force upon sealing members 18. The axial compression force exerted by gland 19 is adjusted by rotating gland nut 2. In particular the rotation of gland nut 2 makes it possible to advance gland 19 longitudinally with respect to the body of pump 10 to adjust the compression force which gland member 19 exerts on sealing members 18.

In order to be able to adjust gland nut 2 this must be accessible from the exterior of pump 10.

In the example illustrated in the figures gland 19 and gland nut 2 are a single piece. Alternatively the gland member and the gland nut may be two separate members.

In accordance with a preferred embodiment gland nut 2 has a threaded portion 6 and a flange 7. Threaded portion 6 is coupled with the threaded portion 8 of a sleeve 9 mounted coaxially with gland nut 2. This sleeve 9 has a threaded portion 20 coupled to threaded portion 21 of a second gland nut 22 and a shoulder 23 which together with gland 19 forms a housing 24 for sealing members 18.

This description relates to a device 1 which is used to adjust gland nut 2. Obviously device 1 according to the invention may be used to adjust second gland nut 22.

Gland 19 has an edge 19*a* capable of pressing sealing members 18 against a wall which is fixed with respect to gland 19. In the example illustrated in the appended figures sealing members 18 press against a wall 23*a* of shoulder 23.

Gland nut 2 is provided with gripping means 8 through which gland nut 2 can be caused to rotate.

In the example illustrated in the figures, gripping means 8 comprise a plurality of recesses 8, 8', 8" made at predetermined angular intervals β along the circumference of the outer edge 7*a* of flange 7, for example by milling. Each recess 8 is defined by two side walls 8*a*, 8*b* and a base 8*c*.

Device 1 for the adjustment of gland nut 2 comprises an engaging member 3 and actuator means to cause engaging member 3 to effect a working movement from a first position to a second position, in the example illustrated in FIGS. 1 to 4 from a first advanced position to a second retracted position.

In particular engaging member 3 is capable of effecting a one-way engagement with gripping means 8 of gland nut 2 so as to rotate gland nut 2 in the working movement from the advanced position to the retracted position through a predetermined angle α.

Device 1 for the adjustment of gland nut 2 is capable of being supported by a portion of the supporting structure 10*a* of pump 10. For example device 1 may be fixed to supporting structure 10*a* of pump 10 through fixing means of the bolt type or the like (not shown in the figures).

Engaging member 3 may be capable of engaging each recess 8, 8', 8" in a one-directional way. Advantageously engaging member 3 is in the shape of a catch and has a portion 4 having a concave surface 4*a* shaped so as to engage side wall 8*a* of recess 8. Also, advantageously, portion 4 has a convex surface 4*b* whose function will be better described with reference to the functioning of device 1.

Advantageously the actuator means comprise a hydraulically operated device 25 having a piston 26 which is pivoted at one extremity 26*a* thereof to engaging member 3 through a shank 27.

Alternatively the actuator means may be of a pneumatically operated or other type.

Hydraulic actuator device 25 is of a known type and is not therefore described in detail.

In order to maintain engaging member 3 in an angular position such as to engage recesses 8 it is possible to provide suitable means (not shown in the figures) to stop the rotation of engaging member 3 about shank 27.

For example it is possible to provide an angular shoulder on the part of the engaging member pivoted at the end of the piston and a corresponding stop member located at the end of the piston against which the angular stop of the engaging member abuts.

Advantageously it is possible to use pre-loaded resilient means which maintain the stop member in an angularly abutting position so as to firmly maintain engagement between engaging member 3 and recesses 8.

Control means (not shown in the figures) may be provided to control the operation of hydraulic piston 26. The control means not only establish the times when hydraulic piston 26 has to be activated, and therefore bring about adjustment of gland nut 2, but make it possible to control the amount by which nut 2 is tightened.

In fact gland nut 2 may be adjusted at preset time intervals ΔT or according to need whenever an operator notices the presence of a leak of liquid from the gland nut. In the latter case it is possible to provide suitable means for detecting the loss of hydraulic fluid from the piston housing.

For example, as illustrated in the figures, the pump may be provided with conduits for the recovery of fluid through which the quantity of recovered liquid can be detected.

When a limiting threshold of recovered liquid, measured for example in liters/hour, is exceeded, the control means may activate the actuator means and adjust the gland nut. Alternatively the operator operating the pump may check the leak of liquid from the gland "by sight" and operate the actuator means of the device for adjusting the gland nut, for example by means of a control switch or a control lever.

In the case where the gland nut is periodically adjusted the control means operate the actuator means at predetermined time intervals ΔT.

The control means make it possible to control the degree to which the gland nut is tightened. This control may be applied by establishing the value of the angle of rotation α which it is desired to impose upon gland nut 2 from the outset, or by providing a pressure sensor which detects the pressure of the feed fluid to the actuator means.

In the first case, it may be possible to determine when angular value α has been reached on the basis of the linear movement of piston 26. In the second case it is necessary to set a pressure value beyond which the pressure sensor causes the hydraulic circuit feeding the hydraulic actuating piston to discharge.

The functioning of the device is described starting from a condition in which catch 3 is in a resting position, and therefore disengaged from recesses 8 (FIG. 1).

In order to cause gland nut 2 to rotate the actuator means are operated to bring catch 3 from the resting position to an advanced position in which catch 3 engages one of recesses 8 (FIG. 2). In particular piston 26 is caused to advance so as to bring portion 4 of catch 3 opposite one of recesses 8 of gland nut 2, so that catch 3 engages that recess 8. Engagement may take place through the action of the force of gravity or, advantageously, through the action of preloaded resilient means which maintain a firm engagement between concave surface 4*a* of catch 3 and side wall 8*a* of recess 8.

At this point piston 26 is actuated to cause catch 3 to effect a working movement from that advanced position (FIG. 2) to a retracted position (FIG. 3). During this working movement from the advanced position to the retracted position catch 3 causes gland nut 2 to rotate through a predetermined angle $\alpha$, thus determining the longitudinal advance of gland 19 with respect to the body of pump 10. In this way gland 19 presses sealing members 18 more firmly against wall 23*a* of shoulder 23 bringing about an increase in the radial compression of sealing members 18 against the walls of piston 13.

The rotation of gland nut 2 may be stopped, as described above, when a predetermined value of the pressure of the feed liquid to the hydraulic piston is achieved, or when a predetermined value of angular rotation $\alpha$ of gland nut 2 is achieved.

When it is necessary to rotate gland nut 2 through an angle of rotation $\alpha$ which causes catch 3 to disengage from nut 2, it is sufficient to stop piston 26 in a withdrawn position in which catch 3 is still engaged with recess 8 (FIG. 2). At this point piston 26 may be actuated to move catch 3 into an advanced position so as to engage a further recess 8'. Through the particular conformation of convex surface 4*b*, catch 3 automatically disengages from recess 8 during the movement in which piston 26 is actuated from the withdrawn position to a new advanced position. Substantially convex surface 4*b* acts as a leading surface to assist disengagement of catch 3 from the recesses.

With reference to FIG. 5, 100 indicates as a whole a device for the adjustment of a gland nut 2 according to an alternative embodiment of this invention.

The parts of device 100 which are structurally and functionally equivalent to device 1 are identified by the same reference numbers and will not be further described.

In accordance with this embodiment engaging member 103, which is pivoted around shank 27, can rotate around shank 27 to engage each of recesses 8 in a one-directional way and rotate gland nut 2 from a first advanced position to a second withdrawn position and vice versa. For this purpose engaging member 103 has two engaging portions 104, 105 provided on opposite sides with respect to the axis of symmetry A-A of member 103. These two opposite engaging portions 104, 105 have corresponding concave surfaces 104*a*, 105*a* shaped in such a way as to engage separate opposite side walls of each recess. Also, advantageously, portions 104, 105 have respective convex surfaces 104*b*, 105*b* having the function described above with reference to the embodiment illustrated in FIGS. 1 to 4.

This embodiment makes it possible to use the device according to the invention to both secure gland nut 2 in movement from the advanced position to the withdrawn position and to ease off gland nut 2 in movement from the withdrawn position to the advanced position.

As will be appreciated from what has been described, the device for the adjustment of a gland nut according to this invention makes it possible to satisfy the requirements and overcome the disadvantages mentioned in the introductory part to this description with reference to the known art.

In fact, as has been seen, use of the device according to the invention, in addition to making the work of adjusting the gland nut safe for the operator, also makes it possible to obtain reproducibility in that adjustment and therefore tightening which is independent of the capacity of the operator.

Another advantage of the device according to the invention lies in the fact that it makes it possible to reduce the wear on the sealing members in that the degree to which the gland nut is tightened in adjustment can be suitably controlled and calibrated according to losses.

Obviously in order to satisfy contingent and specific requirements a person skilled in the art could apply many modifications and variants to the device according to the invention described above, all of which is however included within the scope of protection of the invention as defined by the following claims.

The invention claimed is:

1. Pumping apparatus comprising:

a gland nut and a device for the adjustment of said gland nut, said gland nut being provided with a plurality of gripping means through which said gland nut can be caused to rotate, said device comprising:

an engaging member, and actuator means to cause said engaging member to effect a working movement from a first position to a second position, wherein said engaging member is capable of effecting a one-way engagement with said gripping means in order to rotate said gland nut through a predetermined angle during the working movement from the first position to the second position, said actuator means comprises a hydraulically operated piston, said engaging member is pivoted at an extremity of said piston, said gland nut has a flange having an outer edge, said plurity of gripping means comprise a plurality of recesses provided at predetermined angular intervals along the circumference of the outer edge of said flange, said engaging member being shaped in such a way as to engage each of said plurality of recesses in a one-directional way.

2. Pumping apparatus in accordance with claim 1, in which said engaging member (3) is shaped in the form of a catch.

3. Pumping apparatus according to claim 1, in which said engaging member has a portion having a concave surface shaped in such a way as to effect one-way engagement with each recess of said plurality of recesses.

4. Pumping apparatus according to claim 1, in which said engaging member has a portion having a convex surface capable of assisting disengagement of said engaging member from each of said plurality of recesses.

5. Pumping apparatus according to claim 1, in which said engaging member is capable of performing a working movement from a first advanced position to a second withdrawn position to tighten said gland nut.

6. Pumping apparatus according to claim 1, in which said engaging member is capable of performing a working movement from a first withdrawn position to a second advanced position to slacken off said gland nut.

7. Pumping apparatus according to claim 1, in which control means are provided to control the operation of said actuator means.

8. Pumping apparatus according to claim 1, in which said device for adjusting said gland nut is capable of being supported by a supporting structure of said pumping apparatus.

* * * * *